US008240388B2

(12) United States Patent
Brite

(10) Patent No.: US 8,240,388 B2
(45) Date of Patent: Aug. 14, 2012

(54) SUBMERGIBLE OIL WELL SEALING DEVICE AND METHOD FOR SEALING UNDERWATER OIL WELLS

(75) Inventor: Alan D. Brite, Santa Barbara, CA (US)

(73) Assignee: Alan D. Brite, Santa Barbara, CA (US)

( * ) Notice: Subject to any disclaimer, the term of this patent is extended or adjusted under 35 U.S.C. 154(b) by 202 days.

(21) Appl. No.: 12/833,883

(22) Filed: Jul. 9, 2010

(65) Prior Publication Data

US 2012/0006558 A1 Jan. 12, 2012

(51) Int. Cl.
*E21B 7/12* (2006.01)

(52) U.S. Cl. ..... 166/345; 166/66.4; 166/319; 166/263; 166/285

(58) Field of Classification Search ..... 166/66.4, 166/66.6, 68, 69, 319–323, 263, 285
See application file for complete search history.

(56) References Cited

U.S. PATENT DOCUMENTS

| | | | | | |
|---|---|---|---|---|---|
| 1,880,218 | A | * | 10/1932 | Simmons | 166/382 |
| 2,187,275 | A | * | 1/1940 | McLennan | 166/113 |
| 2,204,586 | A | * | 6/1940 | Grau | 285/36 |
| 2,734,580 | A | * | 2/1956 | Layne | 166/277 |
| 2,796,134 | A | * | 6/1957 | Binkley | 166/207 |
| 2,812,025 | A | * | 11/1957 | Doherty et al. | 166/207 |
| 2,877,849 | A | * | 3/1959 | Morrison et al. | 166/67 |
| 3,095,928 | A | * | 7/1963 | Morrison et al. | 166/97.1 |
| 3,111,991 | A | * | 11/1963 | O'Neal | 166/207 |
| 3,504,742 | A | * | 4/1970 | Crawford | 166/75.13 |
| 3,638,722 | A | * | 2/1972 | Talley, Jr. | 166/338 |
| 3,645,332 | A | * | 2/1972 | Baker | 166/75.13 |
| 3,664,415 | A | * | 5/1972 | Wray et al. | 166/336 |
| 4,273,520 | A | * | 6/1981 | Sutliff et al. | 417/434 |
| 4,305,461 | A | * | 12/1981 | Meyer | 166/77.4 |
| 4,352,394 | A | * | 10/1982 | Zehren | 166/106 |
| 4,363,606 | A | * | 12/1982 | Kilgore | 417/59 |
| 4,383,552 | A | * | 5/1983 | Baker | 138/46 |
| 4,461,354 | A | * | 7/1984 | Buras et al. | 166/343 |
| 4,979,322 | A | * | 12/1990 | Sloan | 37/322 |
| 5,083,386 | A | * | 1/1992 | Sloan | 37/309 |
| 5,284,209 | A | * | 2/1994 | Godfrey | 166/380 |
| 6,230,824 | B1 | * | 5/2001 | Peterman et al. | 175/214 |
| 6,892,819 | B2 | * | 5/2005 | Cook et al. | 166/380 |
| 7,413,023 | B2 | * | 8/2008 | Howlett | 166/387 |
| 2002/0084075 | A1 | * | 7/2002 | Johansen | 166/319 |
| 2005/0028984 | A1 | * | 2/2005 | Donald et al. | 166/368 |
| 2010/0276143 | A1 | * | 11/2010 | Vestavik | 166/285 |

* cited by examiner

*Primary Examiner* — Thomas Beach
*Assistant Examiner* — Aaron Lembo
(74) *Attorney, Agent, or Firm* — Schlee IP International, P.C.; Alexander R. Schlee

(57) ABSTRACT

An oil well sealing device that is submergible for sealing under water oil wells and a method for sealing underwater oil wells are described. The device comprises a housing having at least one lower opening at a lower end of the housing and at least one upper opening at an upper end of the housing; a pump sucking oil through the lower opening into the housing and pushing the oil through the upper opening out of the housing; and a closing element movable to close or open the upper opening.

13 Claims, 1 Drawing Sheet

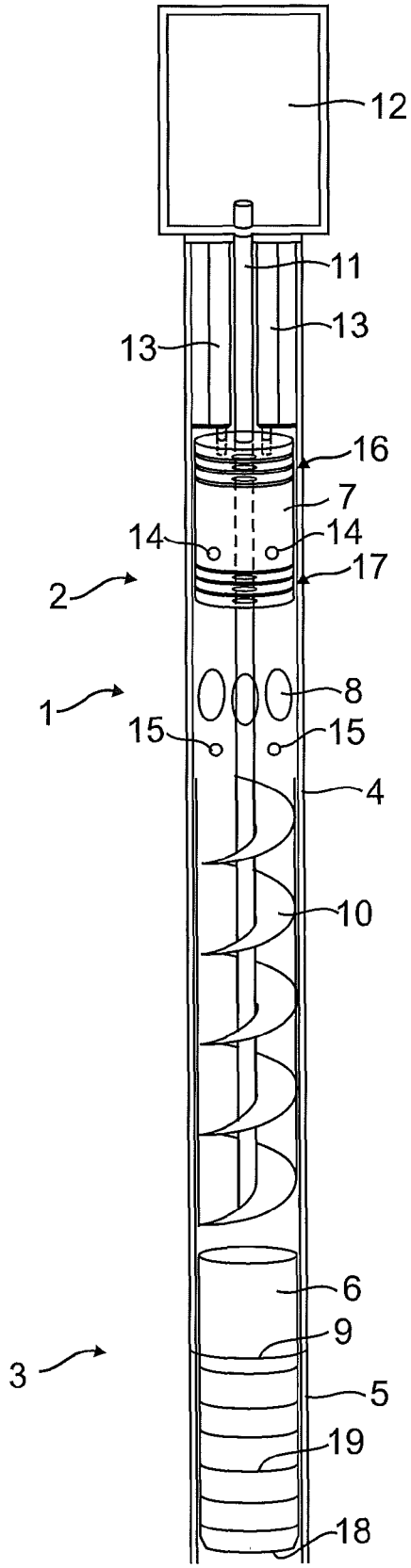
12
11
13
13
16
7
14
14
17
2
1
8
15
15
4
10
6
9
3
5
19
18

SUBMERGIBLE OIL WELL SEALING DEVICE AND METHOD FOR SEALING UNDERWATER OIL WELLS

BACKGROUND OF THE INVENTION

For sealing underwater oil wells, two major problems need to be overcome:

First, the immense pressure of the oil flow coming out of the open oil well pushes all elements that are attempted to be pushed into the oil well for sealing it away. This results particularly from the high oil pressure in combination with a relatively large diameter, for instance an oil well tube having an inner diameter of 20 in.

Second, since the oil well is located deep below the water surface, the oil well is difficult to access due to both the distance from which any sealing equipment has to be operated, as well as due to the high water pressure requiring special equipment. This second part of the sealing problem makes it in particular difficult to apply the forces needed to counter the high pressure oil flow to apply a sealing element to the oil well.

It is an object of the invention to create an oil well sealing device that is capable of sealing underwater oil wells.

SUMMARY OF THE INVENTION

This object is achieved by an oil well sealing device that is submergible for sealing under water oil wells, comprising: a housing having at least one lower opening at a lower end of the housing and at least one upper opening at an upper end of the housing; a pump sucking oil through the lower opening into the housing and pushing the oil through the upper opening out of the housing; and a closing element movable to close or open the upper opening.

This object is further achieved by a method for installing a submergible oil well sealing device, comprising: sucking oil from an underwater oil well at a lower end of the oil well sealing device into said device; pushing the sucked-in oil at an upper end of the device through at least one opening out of said device; installing the lower end of the device to the oil well; and closing the at least one opening at the upper end of the device.

DETAILED DESCRIPTION OF THE DRAWINGS

This apparatus and method according to the invention achieve that the oil well sealing device either lowers the counterforce by actually pumping away the oil at about the same speed as it comes out of the oil well, or even better, depending on the power of the pump, might suck additionally surrounding water into the device. Putting the effect in simple words, the device sucks itself into place and therefore overcomes the need of equipment pushing a sealing device into the well that is very difficult to operate that deep down below the water surface. According to a preferred embodiment, the sucked in oil and possibly additional water may be guided out of the sealing device in a vertical direction upwards, providing additional thrust pushing the sealing device down into the oil well.

According to a preferred embodiment the housing comprises an elongated tube, the lower opening is the entire open cross section of the tube, and the upper opening is a radial opening in the tube. This achieves the maximum intake by avoiding any obstructing of the lower opening of the device. However, as an alternative, also a different shape or partial opening of the lower cross-section is possible, for instance by closing lower opening by a grid. Further, the upper openings do not need to be just radial openings, but could deflect the flow such that it exits the device in the vertical direction upwards, generating additional thrust pushing the entire device in direction of the oil well.

According to another preferred embodiment the pump comprises an auger that rotates within the tubular housing. In the alternative, the pump could actually be of any form or shape. An auger has the advantage of a relatively simple design and can be rotated at relatively high speed, therefore conveying a high oil flow as needed for lowering the pressure from the oil flow enough for pushing the sealing device into the oil well.

According to another preferred embodiment the auger is rotated by a motor that has a reversible rotational direction. Any kind of motor that can be encapsuled in a water tight fashion and therefore operated under water is suitable. Strong electric motors are available both for industrial purposes and for powering automobiles. However, it is also possible to use hydraulic motors that can be fed by hydraulic lines and provide the advantage of high power output at relatively small space. Both electric motors and hydraulic motors can be easily reversed in their rotational direction.

According to another preferred embodiment the closing element is a cylinder that is movable along the tubular housing to cover the upper opening. While it is particularly advantageous to design the closing element as a cylinder that closely tracks the inner wall of the tubular housing and this cylinder can engage that inner wall of the tubular housing by O-rings for establishing a sealing connection, also any other elements capable of shutting and opening the upper openings are possible, e.g. any type of the valves or slide valves that are capable of opening and closing of the upper openings.

According to another preferred embodiment the cylinder can be moved hydraulically. Depending on the force that is needed for moving the cylinder into its closing position, it may be moved hydraulically, either by separate hydraulic cylinders or by pressurizing of the cylinder-shaped closing element directly. Also other means of moving the closing element are available, for instance by a worm gear or a rack and pinion.

According to another preferred embodiment the cylinder comprises at least one biased locking pin that snaps into an interlocking position with the elongated tube when the cylinder has reached its closing position where it closes the upper opening. However, also any other type of locking mechanism is possible, for instance as simple as inserting a locking pin from the outside through the wall of the tubular housing and into a hole provided for this purpose in the closing element. It is also possible to simply continue holding the locking element in place by the driving mechanism moving it into the closing position, for instance the hydraulic cylinders, or via the worm gear or rack and pinion.

According to another preferred embodiment the cylinder comprises on its circumference at least 2 spaced apart O-rings that are spaced apart at least by a distance of the size of the upper radial openings in longitudinal direction of the tube. While O-rings are a preferred type of sealing for providing a self-sealing effect under pressure, also any other type of common sealing can be used.

According to another preferred embodiment the lower end of the device is adapted to be connected to a spigot joint that is attachable in a sealed fashion to the oil well. The spigot joint may preferably have a spigot sleeve that can be pre-attached to the tubular housing and protrude therefrom by such a length as it is desired to be inserted into the oil well tube. For sealing the protruding portion in relation to the oil well tube, the protruding portion may carry O-rings on its circumference that engage the inner wall of the oil well tube when inserted therein. Again, O-rings provide the advantage of a self-sealing effected under pressure so that the oil pressure actually helps to accomplish a sealing action.

According to a preferred embodiment of the method according to the invention, the pumping direction is reversed after installing the lower end of the device to the oil well has been completed, therefore pumping in a direction from the upper end of the device toward the lower end of the device where the device is connected to the oil well. Depending on the force that can be transmitted by the means moving the closing element into its closing position, this force might be strong enough so that reversing the pumping direction may not be needed. However, since the pump and all other elements like the motor driving the pump are already in place, the pumping direction may as well be reversed with very little effort, lowering the oil pressure on the closing element so that less force is needed to move the closing element from its open into its closing position. This allows also smaller dimensions, for instance of the hydraulic cylinders urging the closing element into its closing position.

According to another preferred embodiment of the method according to the present invention an auger is provided as a pump, said auger rotating within the housing that is shaped as a tube and rotating the auger first into a first direction during installation of the oil well sealing device and then into a second direction after the lower end of the device has been installed to the oil well. An auger is a relatively simple and effective pump and can be rotated at relatively high speed, for instance 2000 to 3000 rpm. However, any other type of pumps can be used such as piston pumps or rotary vane pumps.

According to another preferred embodiment of the method according to the present invention an electric motor for driving the auger and changing the rotational direction by reversing polarity of the electric motor is provided. An electric motor has the advantage that the rotational direction can easily be changed by reversing the polarities of the electric motor. However, also other types of motors are capable of reversing the rotational direction readily, for instance hydraulic motors. Also, it is possible to change the rotational direction by a change gear moving from a forward gear to a reverse gear.

According to another preferred embodiment of the method according to the present invention a hollow spigot sleeve is installed to the lower end of the device and then the spigot sleeve is pushed in a sealing fashion into the oil well. However, it is also possible to reverse the sequence of installation steps according to another preferred embodiment, namely by installing a hollow spigot sleeve to the oil well and then installing the lower end of the device to the spigot sleeve. The latter installation sequence might be a little more cumbersome since it requires the extra step of attaching the spigot sleeve first to the oil well tube, but should also be possible since the spigot sleeve is hollow and therefore free from being subjected to a high force rejecting the spigot sleeve by the oil flow from the oil well.

The invention is described in more detail in the following by referring to the drawing.

BRIEF DESCRIPTION OF THE DRAWINGS

FIG. 1 shows a schematic side sectional view of an embodiment of the oil well sealing device according to the present invention.

DETAILED DESCRIPTION OF THE DRAWINGS

The FIGURE shows a schematic side view of the submerged oil well sealing device 1 for sealing underwater oil wells. The device comprises an upper end 2 and a lower end 3 and extends during use substantially in vertical direction. The device comprises the shape of an elongated tube, particularly sized for having a diameter of a typical oil well tube 5, for instance a diameter of 20 in or larger, depending on the size of the oil well. The entire device is for instance 18 ft. long. A spigot sleeve 6 is either pre-installed into the housing 4, for instance by a press fitting or welded to the housing 4, or it is pre-installed into the oil well tube 5 so that the spigot sleeve protrudes the oil well tube 5 by a certain distance. This protruding part has an outer diameter that is a little smaller than the inner diameter of the tube-shaped housing 4. In any of the two aforementioned alternatives, the spigot sleeve is designed to center the housing 4 and connect it with of the oil well tube 5. O-rings 19 can optionally be provided, sealing the spigot sleeve 6 with respect to the oil well tube 5, or optionally also with respect to the tube-shaped housing 4.

The oil well sealing device 1 comprises further a closing element 7 that is shaped according to this embodiment as a cylinder interacting with several upper openings 8, in this case eight upper openings 8 spaced apart around the circumference of the tube-shaped housing 4 at the upper end 2 of the device, and a lower opening 9 that is simply according to this embodiment the lower open cross-section of the tube-shaped housing.

An auger 10 is provided within the tube-shaped housing 4, and is driven via a shaft 11 that is rotated by an electric motor 12. Two hydraulic cylinders 13 are provided for moving the closing element 7 along the tube-shaped housing 4, particularly into a closing position where the upper openings 8 are closed, i.e. substantially to prevent that oil coming from the oil well can escape the sealing device once it has been installed and is moved into its closed position. The closing element 7 also prevents water from the outside to penetrate through the upper openings 8 into the sealing device. When the closing element 7 has been moved into its closing position, one or more biased locking pins 14 may snap into place, locking the closing element into its closing position. These locking pins 14 may for instance snap into holes or recesses 15 that are formed in the wall of the tube-shaped housing 4.

The closing element 7 may carry two sets of O-rings, namely a first set of O-rings 16 and a second set of O-rings 17. These two sets of O-rings 16 and 17 are spaced apart by a distance that is larger than the longitudinal size of the openings 8 measured in the longitudinal direction of the tube-shaped housing 4. In the locked position of the closing element 7, the first set of O-rings 16 is vertically above the upper openings 8, and the second set of O-rings 17 is in vertical direction in the locked position of the closing element 7 below the upper openings 8.

In the following, the process of installing the oil well sealing device and finally sealing the oil well are described.

The oil well sealing device is used as a stand-by device in case an underwater oil well gets out of control as far as the ability to seal the oil well is concerned. The main problem of sealing an oil well is the extreme pressure under which oil comes out of the oil well, creating a fast flow of pressurized oil. This powerful oil flow prevents installing any plugs sealing the well. The embodiment of the invention as described above targets this problem by actively pumping the oil off so that the pressure pushing any sealing plug into the oil well is reduced to a minimum that can be overcome by force or gravity, or in the ideal situation, even provides a positive attractive force sucking the entire oil well sealing device into place.

The device 1 is lowered to be basically aligned with the oil well at such a distance that the oil flow coming out of the oil well tube 5 allows without any further action. Then, the electric motor 12 is started. As an electric motor, for instance a motor of an electric car can be used that is capable of providing rotational speeds of over 2000 rpm. Via a shaft 11, the auger 10 is rotated, sucking in water and some oil through a lower opening 9. If the spigot sleeve 6 is pre-attached to the tube-shaped housing 4, the mixture of water and oil is sucked in through the lower opening 18 of the spigot sleeve 6. The mixture of oil and water sucked into the tube-shaped housing by the auger can leave the housing 4 radially through the upper openings 8. In another preferred embodiment, outlet tubes can be attached to the radial openings 8, deflecting the radial liquid stream upwards in axial direction of the tube-shaped housing, creating additional push in the direction of the oil well. Instead of radial upper openings, it is also possible to guide the flow through the tube-shaped housing 4 to the very upper end and exhaust this flow in a vertical direction upwards, creating extra thrust and therefore push on the entire device 1 downwards. In this case, the electric motor 12 needs to be either installed laterally, or tubes can guide the flow around the electric motor 12.

The sucking action allows lowering the entire device 1 even further, until the pre-attached spigot sleeve 6 can enter into the oil well tube 5. The tube-shaped housing 4 can then be anchored to the oil well tube 5 in a conventional manner, for instance by anchors or other fastening devices. Also, the spigot sleeve 6 may be pressed-fit into the oil well 5. Also, locking pins or locking screws are an option.

After the tube-shaped housing 4 has been fixed to the oil well tube 5, the auger still rotates initially in the same direction, now only pumping oil and no water from the oil well out through the upper openings 8. Since the ultimate goal is to seal the oil well, now the upper openings 8 need to be closed. For this purpose, the closing element 7 is pushed down via the hydraulic cylinders 13 so that the second set of O-rings 17 rests below the openings 6 while the first set of O-rings still remains above the openings 8. In other words, the openings 8 are sandwiched between the two sets of O-rings 16 and 17 in the closing position of the closing element 7. When the closing element 7 has reached its closing position, it can be locked with respect to the tube-shaped housing 4, for instance by locking pins 14 snapping into respective recesses or holes 15 provided in the wall of the tube-shaped housing 4. The closing element 7 may likewise be locked by other means into its closing position, for instance by locking pins inserted from the outside of the housing 4, or any other type of latch that may for instance engage the plane top face of the cylinder-shaped closing element 7.

In order to facilitate the movement of the closing element 7 into its closing position, the rotational direction of the auger can be reversed prior to or during movement of the closing element. This reverses the pumping direction, namely now with the reversed rotational direction no oil is pumped out of the oil well, but to the contrary, water is pumped from the openings 8 into the oil well if the pumping pressure and respectively the electric motor 12 are strong enough for reversing entirely the direction of flow. However, even if the power of the electric motor 12 and respectively the rotational speed of the auger are not sufficient for entirely reversing the direction of flow, at least the pressure from the oil acting upon the lower front face of the closing element is reduced, allowing the closing element 7 to be pushed downwards with less force by the hydraulic cylinders 13.

With the closing element 7 locked in its closing position and the tube-shaped housing 4 being attached to the oil well tube 5, the oil well is now sealed and the electric motor 12 can be turned off.

What is claimed is:

1. An oil well sealing device that is submergible for sealing underwater oil wells, comprising:

a housing having at least one lower opening at a lower end of the housing and at least one upper opening at an upper end of the housing;

a pump sucking oil through the lower opening into the housing and pushing the oil through the upper opening out of the housing; and a closing element movable to close or open the upper opening, wherein the housing comprises an elongated tube comprising a tube wall, the lower opening is the entire open cross section of the tube, and the upper opening is a radial opening in the tube wall; and the pump comprises and auger that rotates within the tubular housing.

2. The oil well sealing device according to claim 1, wherein the auger is roated by a motor that has a reversible rotational direction.

3. The oil well sealing device according to claim 1, wherein the closing element is a cylinder that is movable along the tubular housing to cover the upper opening.

4. The oil well sealing device according to claim 3, wherein the cylinder can be moved hydraulically.

5. The oil well sealing device according to claim 3, wherein the cylinder comprises at least one biased locking pin that snaps into an interlocking position with the elongated tube when the cylinder has reached its closing position where is closes the upper opening.

6. The oil well sealing device according to claim 3, wherein the cylinder comprises on its circumference at least 2 spaced apart O-rings that are spaced apart at least by a distance of the size of the upper radial openings in longitudinal direction of the tube.

7. The oil well sealing device according to claim 1, wherein the lower end of the device comprises a spigot sleeve connection that is attachable in a sealed fashion to the oil well.

8. A method for installing a submergible oil well sealing device, comprising:

sucking oil from an underwater oil well at a lower end of the oil well sealing device into said device;

pushing the sucked-in oil at an upper end of the device through at least one opening out of said device;

installing the lower end of the device to the oil well by fastening fastening devices that connect the oil well sealing device to the oil well; and closing the at least one opening at the upper end of the device.

9. The method of claim 8, further comprising reversing the pumping direction after installing the lower end of the device to the oil well has been completed to pump in a direction from the upper end of the device toward the lower end of the device where the device is connected to the oil well.

10. The method of claim 9, further comprising providing as a pump an auger rotating within the housing that is shaped as a tube and rotating the auger first into a first direction during installation of the oil well sealing device and then into a second direction after the lower end of the device has been installed to the oil well.

11. The method of claim 10, further comprising providing an electric motor for driving the auger and changing the rotational direction by reversing polarity of the electric motor.

12. The method of claim 8, further comprising installing a hollow spigot sleeve to the lower end of the device and then pushing the spigot sleeve in a sealing fashion into the oil well.

13. The method of claim 8, further comprising installing a hollow spigot sleeve to the oil well and then installing the lower end of the device to the spigot sleeve.

* * * * *